US005842906A

United States Patent [19]

Terzian et al.

[11] Patent Number: 5,842,906

[45] Date of Patent: Dec. 1, 1998

[54] WALKING MECHANISM FOR TOYS

[75] Inventors: Rouben T. Terzian; R. Blake Kuralt, both of Chicago, Ill.

[73] Assignee: Breslow, Morrison, Terzian & Associates, L.L.C., Chicago, Ill.

[21] Appl. No.: 797,581

[22] Filed: Feb. 7, 1997

[51] Int. Cl.[6] ..... A63H 7/00; A63H 11/18

[52] U.S. Cl. ..... 446/330; 446/377; 446/383

[58] Field of Search ..... 446/316, 330, 446/352–356, 376, 377, 383

[56] References Cited

U.S. PATENT DOCUMENTS

| | | | |
|---|---|---|---|
| 129,622 | 7/1872 | Tellner . | |
| 454,570 | 6/1891 | Moore | 446/355 |
| 1,538,140 | 5/1925 | Spelling . | |
| 3,267,607 | 8/1966 | Ryan | 446/355 |
| 3,648,405 | 3/1972 | Tepper | 446/330 |
| 3,940,879 | 3/1976 | Glass et al. . | |
| 4,177,602 | 12/1979 | Choi . | |

FOREIGN PATENT DOCUMENTS

| | | | |
|---|---|---|---|
| 809.002 | 2/1937 | France . | |
| 982.795 | 6/1951 | France . | |
| 328864 | 4/1919 | Germany . | |
| 240175 | 11/1925 | United Kingdom | 446/355 |
| 282305 | 11/1927 | United Kingdom . | |

*Primary Examiner*—Robert A. Hafer
*Assistant Examiner*—Laura Fossum
*Attorney, Agent, or Firm*—Dick and Harris

[57] ABSTRACT

A walking mechanism for a toy doll or character having at least one pair of legs. Each leg has a hip end and a foot end. A pair of elliptical idler gears are mounted for rotation about a common shaft, 180 degrees out-of-phase. A second pair of elliptical gears, each in driving relationship with a respective one of the elliptical idler gears are also 180 degrees out-of-phase. The hip end of each leg is mounted for movement with a stub shaft that is in a driven relationship with a respective one of the 180 degree out-of-phase elliptical driving gears to produce a varying speed, generally elliptical orbital movement of the legs to simulate walking.

16 Claims, 5 Drawing Sheets

WALKING MECHANISM FOR TOYS

BACKGROUND OF THE INVENTION

1. Field of the Invention

This invention relates generally to walking mechanisms for toys such as dolls and more particularly to gear-driven walking mechanisms.

2. Background Art

Dolls and other toys that walk have long been popular playthings. There have been numerous attempts in the prior art to provide both two-legged and four-legged toys with a mechanism in which movement of the legs is coordinated through a gear system to simulate human or animal walking movements. Among such prior art attempts have been motor-driven walking mechanisms as in Tellner U.S. Pat. No. 129,622, Spelling U.S. Pat. No. 1,538,140, Glass et al. U.S. Pat. No. 3,940,879, Choi U.S. Pat. No. 4,177,602, British Patent No. 282,305, French Patent No. 809,002, French Patent No. 982,795 and German Patent No. 328,864.

SUMMARY OF THE INVENTION

The present invention is concerned with providing a walking mechanism for a toy such as a doll having at least one pair of legs with each leg having a hip end and a foot end. A pair of elliptical idler gears are mounted for rotation about a common shaft, 180 degrees out-of-phase. A second pair of elliptical gears, each in driving relationship with a respective one of the elliptical idler gears, are also mounted for rotation 180 degrees out-of-phase. The hip end of each leg is mounted for movement with a stub shaft that is in a driven relationship with a respective one of the 180 degree out-of-phase elliptical driving gears to produce a varying speed, generally elliptical orbital movement of the legs to simulate walking.

The elliptical driving gears are each drivingly connected to one of the stub shafts through at least one member carrying a pin that is received in an elongated arcuate slot and also through another member that carries a pin received in a second elongated arcuate slot. One of the elongated arcuate slots is generally horizontally disposed and the other is generally vertically disposed.

The gears are carried by at least one plate which has an upper portion and a lower portion. The doll has a lower torso and an upper torso with the lower portion of the mounting plate seated in the lower torso. The upper torso has at least one inwardly directed flange and the upper portion of the mounting plate has a notch with the inwardly directed flange fitting into the notch to retain the upper torso atop the lower torso.

BRIEF DESCRIPTION OF THE DRAWINGS

For a better understanding of the present invention, reference may be had to the accompanying drawings in which.

DETAILED DESCRIPTION

Figure 2:
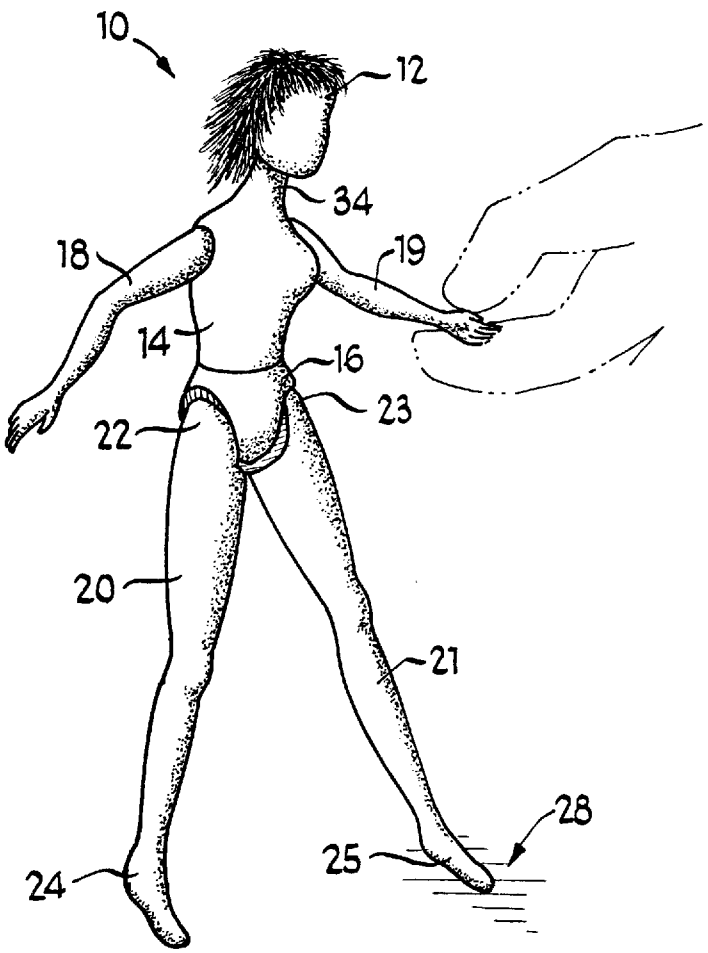
FIG. 2 is a perspective view showing the toy doll in a simulated walking position advanced from that shown in FIG. 1 with the left foot of the toy doll now supported upon a generally planar surface while a child or other human continues to hold the left hand of the doll.
Figure 1:
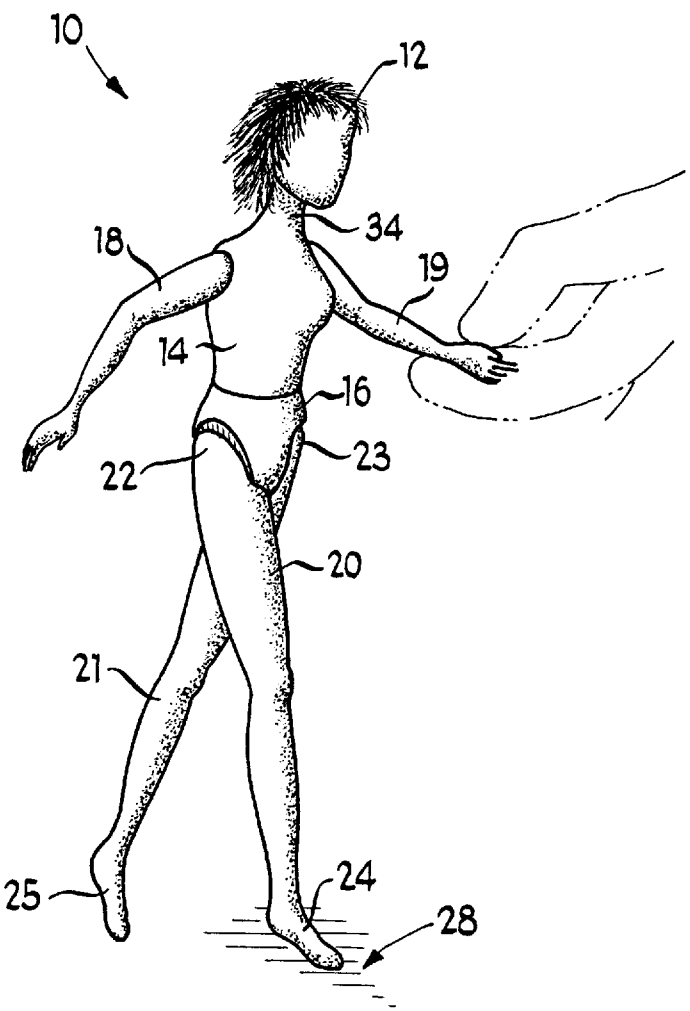
FIG. 1 is a perspective view of an embodiment of the present invention in which the toy doll is in a simulated walking position with its right foot supported upon a generally planar surface and a child or other human holding the left hand of the doll.

Referring now to the drawings in which like parts are designated by like reference numerals throughout the several views, there is shown in FIG. 1 a toy doll 10 having a head 12 which is supported upon an upper torso 14 connected to a lower torso 16. Extending outwardly from upper torso 14 and mounted for pivotal movement with respect to upper torso 14 are a right arm 18 and a left arm 19. Mounted on either side of lower torso 16 are a right leg 20 and a left leg 21. Each leg having at its upper end a hip 22, 23 and at its lower end a foot 24, 25. Legs 20 and 21 are each mounted adjacent their respective hips for relatively opposed movement with respect to each other to simulate walking by doll 10 along a generally planar surface 28 when doll 10 is supported and pulled or pushed in a direction generally parallel to the generally planar surface. Such pulling or pushing may be effected by a child or other user holding a hand at one end of arm 19 in a manner depicted by the broken line showing in FIGS. 1 and 2.

Figure 3:
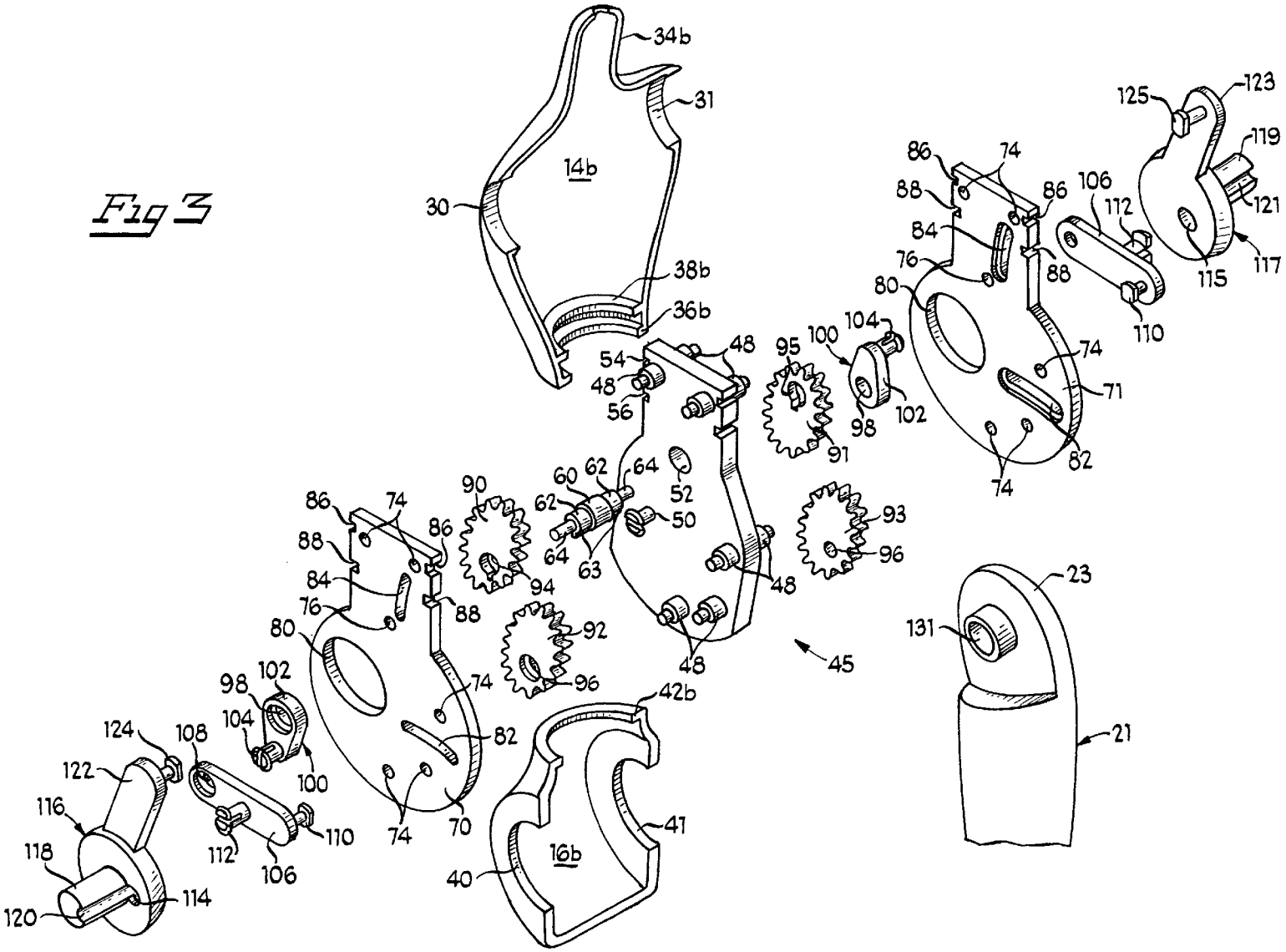
FIG. 3 is an exploded perspective view of the mechanism of the embodiment of the present invention.
Figure 5:
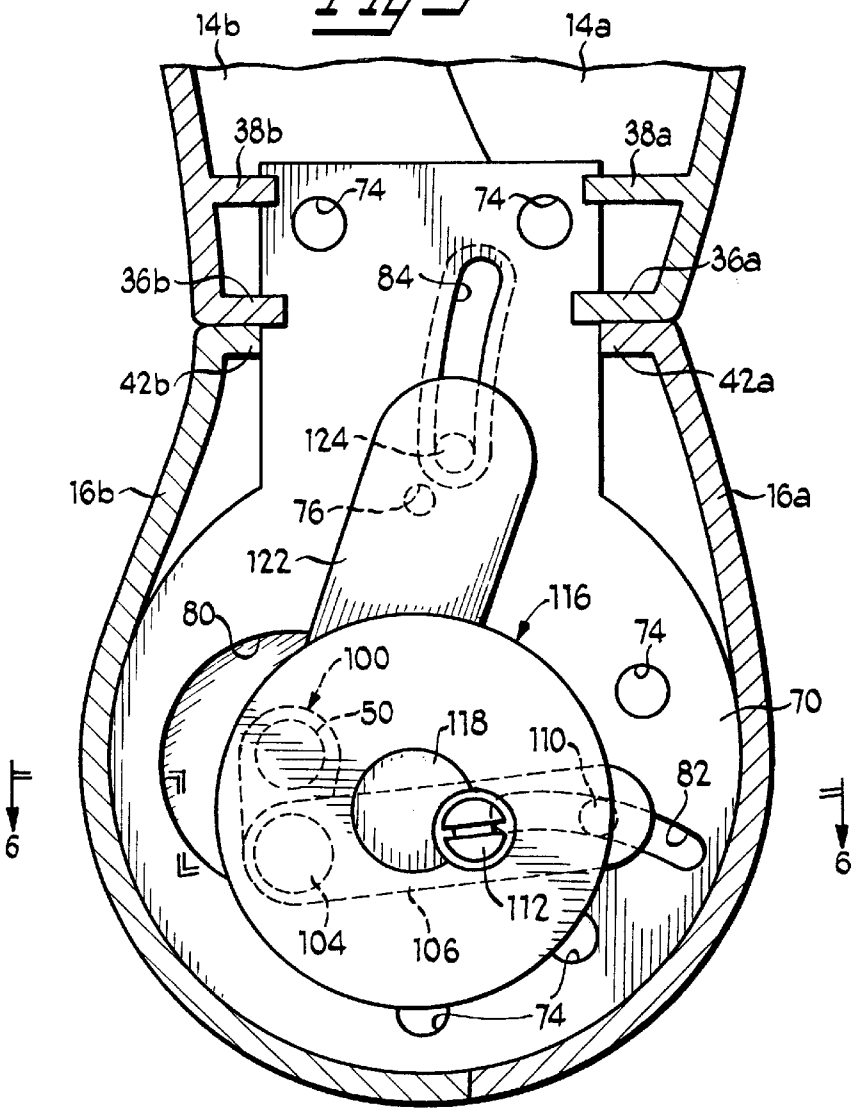
FIG. 5 is a fragmentary sectional view taken generally along line 5—5 of FIG. 4.

As is best shown in FIGS. 3 and 5, upper torso 14 is made up of a front upper torso shell 14*a* and a back upper torso shell 14*b*. Similarly lower torso 16 is formed by a front lower torso shell 16*a* and a back lower torso shell 16*b*. Back upper torso shell 14*b* has arcuate right and left cut-outs 30 and 31 respectively, which mate with corresponding cut-outs (not shown) in front upper torso shell 14*a* to provide for mounting of arms 18 and 19 in a manner that is conventional in the doll and toy action figure art and which allows for pivotal movement of each of arms with respect to the upper torso. Extending upwardly from upper torso 14 is a neck 34, one-half of which is formed by upward extension 34*b* of rear upper torso shell 14*b*. At the bottom of rear upper torso shell 14*b* is an inwardly directed flange 36*b*. Spaced above flange 36*b* is another inwardly directed flange 38*b*. Front upper torso shell 14*a* contains a corresponding lower flange 36*a* which cooperates with lower flange 36*b* and an upper inwardly extending flange 38*a* which cooperates with upper flange 38*b*.

Back lower torso shell 16*b* has arcuate right and left cut-outs 40 and 41, respectively, which mate with corresponding cut-outs (not shown) in front lower torso shell 16*a* to provide for pivotal mounting of legs 20 and 21. Adjacent the top of back lower torso shell 16*b* is an inwardly directed flange 42*b*. Mechanism 45 for effecting walking motion of legs 20 and 21 is contained substantially within the hollow interior of the upper and lower torsos as formed by upper torso shells 14*a*, 14*b* plus lower torso shells 16*a*, 16*b*. The front and back shells of each of the upper and lower torso are conveniently secured together in a manner conventional in the doll making art. Thus, for example, the front and back shells may be secured together by mating pins and apertured bosses (not shown) between which there is a press or interference fit. Alternatively, the mating shells, which are made of plastic, may be secured together by adhesives or ultrasonic welding.

Mechanism 45 is centered about central mounting plate 46. Extending laterally from either side of plate 46 are a series of shouldered pins or mounting bosses 48 which may be integrally formed as part of plate 46. Each of the shouldered pins or mounting bosses 48 have a reduced diameter free end. Also extending laterally outwardly from either side of central mounting plate 46 is a shaft 50 having an upset, bifurcated free end. Disposed above shafts 50, approximately midway between shafts 50 and the top of plate 46, and generally centrally disposed fore to aft of plate 46, is a bore 52 that extends from one side of plate 46 through to the other. Extending inwardly from each of the forward and rearward edges of central mounting plate 46 is a pair of top to bottom spaced apart notches 54 and 56. Notches 54 and 56 are each substantially as thick, and spaced apart as far, as flanges 36*a*, 36*b* and 38*a*, 38*b*. Received in bore 52 for rotation relative to plate 46 is a shaft 60 having opposed outwardly extending step down portions 62. Each of portions 62 has a key 63. In addition, each of step down portions 62 is further stepped down in an outwardly extending terminal pin 64.

Disposed on, and spaced from, each side of central mounting plate 46 is a right side plate 70 and a left side plate 71. Extending through each of side mounting plates 70 and 71 is a series of five apertures 74 which align with shouldered pins or mounting bosses 48 extending laterally from plate 46 such that the reduced diameter free end of each of the shouldered pins or mounting bosses 48 fit in a respective bore 74 in a press or interference fit. There is also a more centrally disposed aperture 76 extending through each of side mounting plates 70 and 71. Apertures 76 are coaxially aligned with bore 52 of central plate 46. The terminal pins 64 of shaft 60 are received in each of bores 76 in a press or interference fit. In the bottom portion of each of the side plates 70 and 71, adjacent their rearward edges is a large diameter aperture 80. Forward of aperture 80 is a generally horizontally disposed arcuate slot 82 extending through each of side plates 70 and 71. Another arcuate slot 84, with generally the same dimensions as slot 82 but having a generally vertical orientation, extends through each of side plates 70 and 71. Each of horizontally disposed arcuate slots 82 and vertically disposed arcuate slots 84 is counter-sunk on the inboard side of side mounting plate 70 and 71, as may be seen with respect to side plate 71 in FIG. 3. On the forward and rearward edges of each of side plates 70 and 71 are a pair of spaced apart notches 86 and 88. As with notches 54 and 56 in central mounting plate 46, notches 86 and 88 are of substantially the same thickness, and spaced apart substantially the same distance, as flanges 36*a*, 36*b* and 38*a*, 38*b*.

Figure 8:
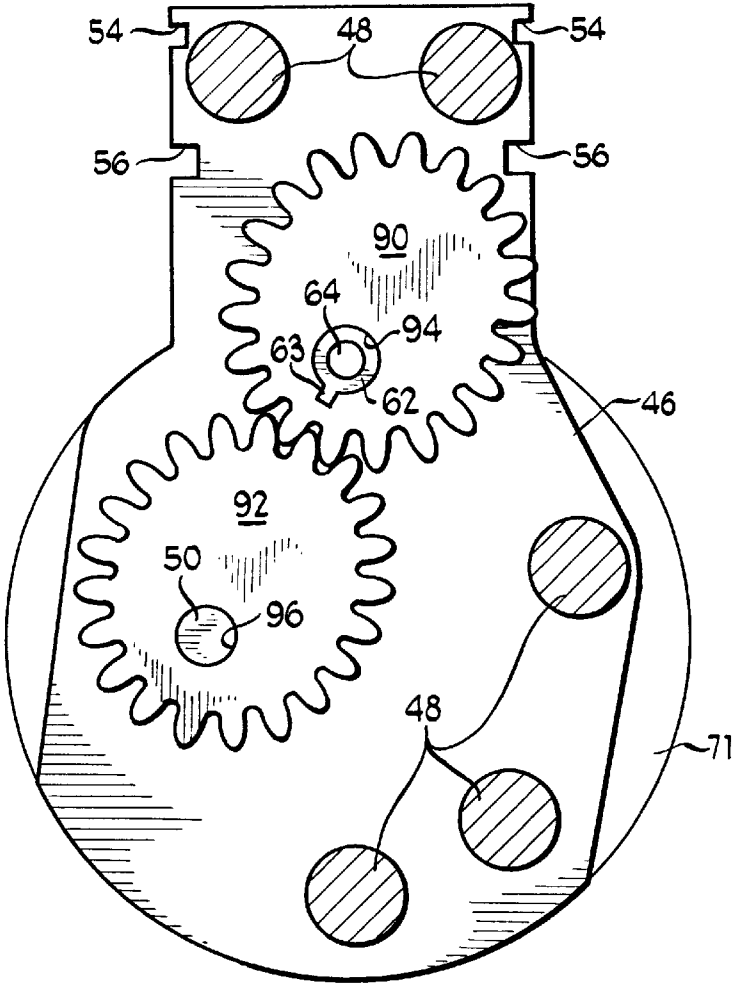
FIG. 8 is a fragmentary sectional view taken generally along line 8—8 of FIG. 4.

Mounted between central plate 46 and each of side plates 70 and 71 are upper elliptical idler gears 90 and 91 and lower elliptical driving gears 92 and 93. Each of elliptical gears 90, 91, 92 and 93 is formed with the same odd number of teeth as illustrated in FIG. 8 (for ease of illustration in the exploded perspective view of FIG. 3, an even number of teeth have been used). Extending through each of elliptical gears 90 and 91, adjacent one end of the long axis, is a keyhole 94 and 95, respectively. Each keyhole 94 and 95 cooperates with step down portion 62 having key 63 to mount elliptical gears 90 and 91 for rotation with shaft 60. Keyhole 94 is oriented adjacent one long end of elliptical gear 90 while keyhole 95 is in an opposed orientation adjacent a long end of elliptical gear 91. Accordingly, elliptical gears 90 and 91 will each be keyed in an opposed, substantially 180 degree out-of-phase, relationship on shaft 60. That is, as viewed in FIG. 3, upper elliptical gear 90 will be extending upwardly relative to shaft 60 while upper elliptical gear 91 will be extending downwardly with respect to shaft 60. As shaft 60 and elliptical gears 90 and 91 rotate, the approximately 180 degree out-of-phase relationship between gears 90 and 91 will be maintained by virtue of the cooperation of key 63 with each of keyholes 94 and 95. Rotation of one of elliptical driving gears 92, 93 results, through elliptical idler gears 90, 91, in a varying speed of rotation of the other of driving gears 92, 93.

Figure 7:
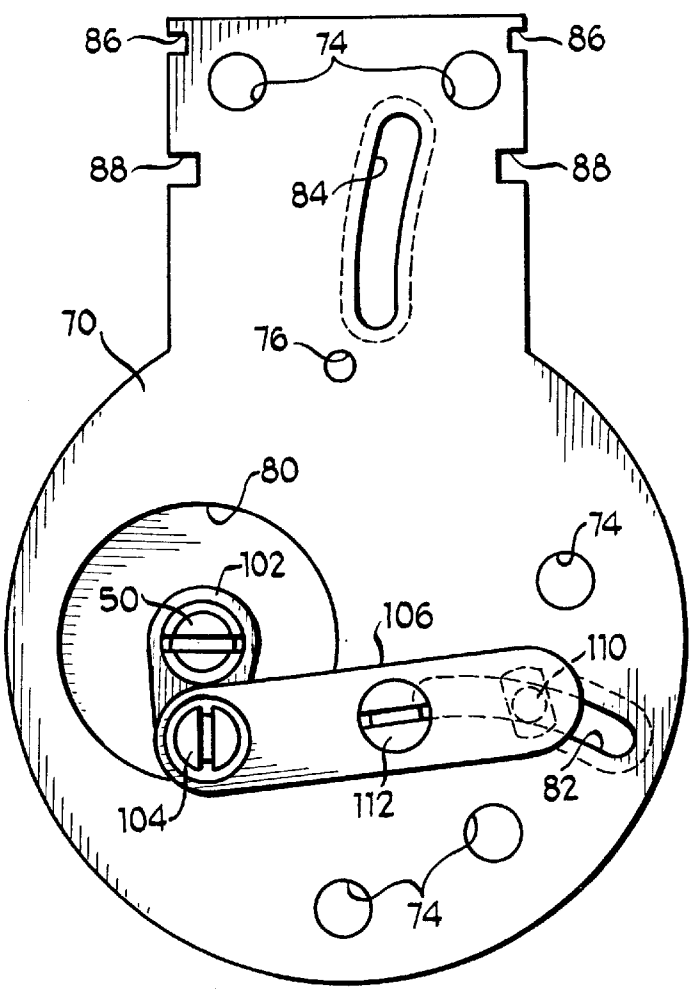
FIG. 7 is a fragmentary sectional view taken generally along line 7—7 of FIG. 4.

Each of lower elliptical gears 92 and 93 has a bore 96 extending through the gear adjacent one elongated end of the gear and is mounted for rotation about a respective one of the laterally extending upset end bifurcated shafts 50. As is perhaps best illustrated in FIGS. 4 and 7, upset end bifurcated shaft 50 extends not only through bore 96 of lower elliptical gear 92 but continues to pass on through counter-sunk bore 98 in eccentric 100. The upset end of shaft 50 sits in counter-sunk bore 98 and retains eccentric 100 and lower elliptical gear 92 from removal along the axis of shaft 50. However, both lower gear elliptical 92 and eccentric 100 are free to rotate about the circumference of shaft 50. Body 102 of eccentric 100 is received for rotation in aperture 80.

Extending outwardly from an end of eccentric 100, opposite the end through which counter-sunk board 98 extends, is a projecting, upset end bifurcated shaft 104. An elongated carrier link 106 has a counter-sunk bore 108, at one end with the counter-sunk portion being on the outboard face of elongated carrier link 106. Extending inwardly from the inboard side of elongated carrier link 106, adjacent the end opposite counter-sunk bore 108 is an upset head pin 110. Projecting outwardly from the outboard face of elongated carrier link 106 is an upset end bifurcated shaft 112. Upset end bifurcated shaft 104 extends through counter-sunk bore 108 with the upset end seated in the counter-sunk portion. Bore 108 is sized to permit rotation of carrier link 106 around the body of shaft 104. Upset head pin 110 is received for sliding, reciprocating movement in counter-sunk arcuate slot 82. Thus, as eccentric 100 rotates within aperture 80, the connection between post 104 and counter-sunk bore 108, together with the cooperation of pin 110 in slot 82, results in a front to back, reciprocating elliptical orbital movement of elongated carrier link 106.

Upset end bifurcated shaft 112 of elongated crank arm 106 extends through a bore 114 in a leg mounting member 116. Leg mounting member has an outwardly extending mounting stub shaft 118, the axis of which is substantially parallel to the axis of bore 114. Bore 114 is offset from the center of leg mounting member 116 while the axis of stub shaft 118 is substantially concentric with the center of leg mounting member 116. There is an arcuate indentation 120 in the outer cylindrical surface of stub shaft 118 but is coextensive with a portion of bore 114 to accommodate post 112. Also forming part of leg mounting member 116 is an offset angled arm 122. An upset head pin 124 extends inwardly from the inboard face of offset arm 122. Upset head pin 124 is received for reciprocating sliding movement in generally vertically disposed arcuate slot 84. As elongated carrier link 106 moves in its generally reciprocating elliptically orbiting path, it effects a generally elliptical orbiting of leg mounting stub shaft 118 which is further guided by upset head pin 124 moving back and forth along generally vertically oriented arcuate slot 84.

Figure 4:
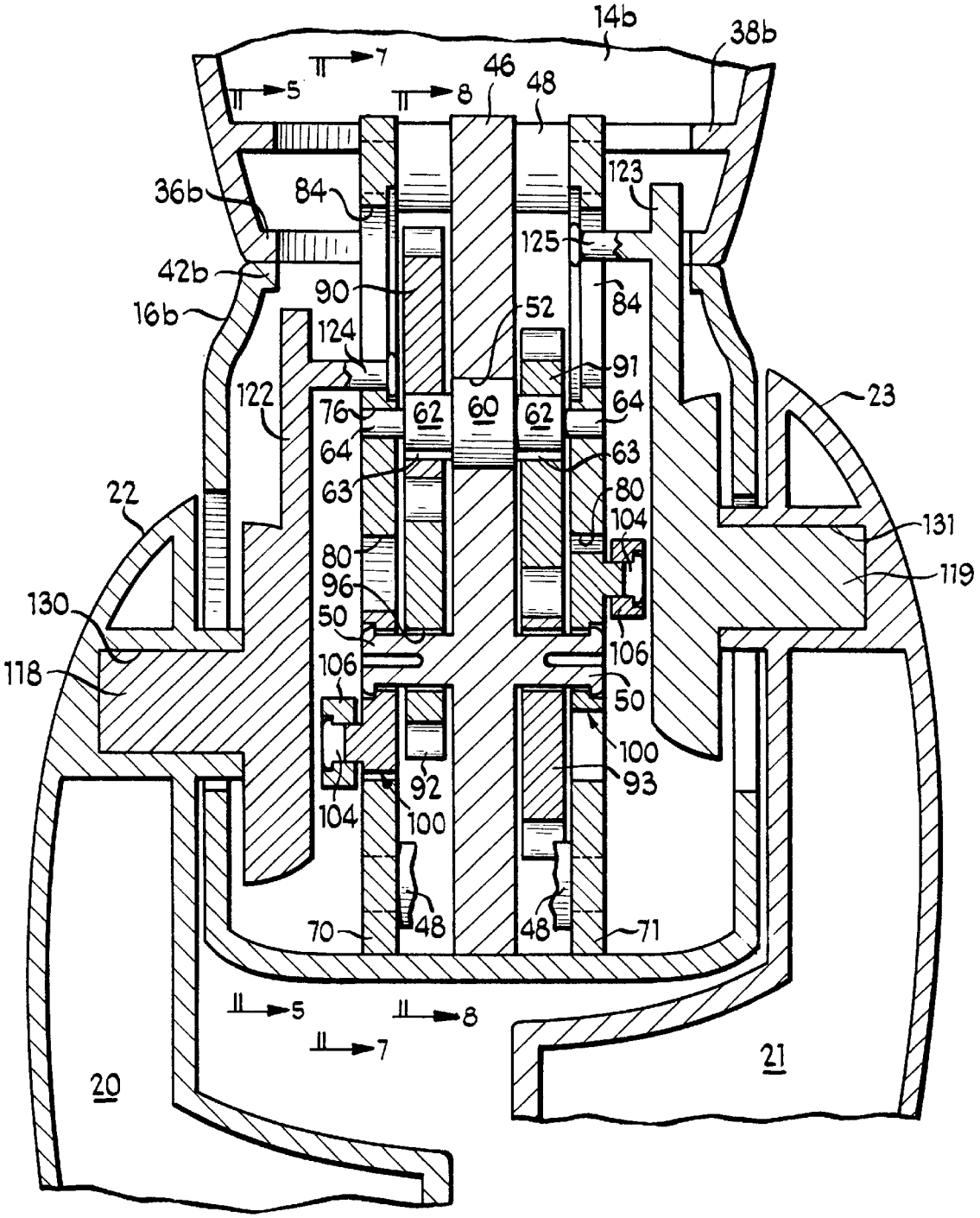
FIG. 4 is an enlarged scale, fragmentary sectional view taken generally along a vertical plane between the front and back of the toy doll and viewed from the front.

Each of eccentric 100 and elongated carrier link 106 are also mounted and move in a similar manner on the left hand side, but 180 degrees out-of-phase with the right hand side. Left leg mounting member 117 is similar to right leg mounting member 116 but its components are obversely oriented as illustrated in FIGS. 3 and 4. The left hand mounting member includes a bore 115 offset from the center of leg mounting member 117 toward the forward edge. Left leg mounting stub shaft 119 includes an arcuate recess 121, which like recess 120 in stub shaft 118, is on the forwardly disposed cylindrical surface of the stub shaft. An offset arm 123 extending from leg mounting member 117 is angled upwardly and toward the front of the doll. An upset head pin 125 extends inwardly from the inboard face of left leg mounting member 117. Upset head pin 125 is received for movement along arcuate counter-sunk slot 84 in left mounting plate 71.

Adjacent hip end 22, leg 20 is provided with a leg mounting socket 130 in which leg mounting stub shaft 118 is received in a press or interference fit. Similarly, adjacent hip end 23 of leg 21 a leg mounting socket 131 is provided. Left leg mounting stub shaft 119 is received in socket 131 in a press or interference fit. Thus, each of legs 20 and 21 move in the elliptical orbital path of leg mounting stub shafts 118 and 119, respectively. Because each of elliptical gears 90 and 91 are keyed for rotation with common shaft 60, their 180 degree out-of-phase relationship and hence the out-of-phase relationship of the rest of each of the right and left hand mechanisms will be maintained.

Figure 6:
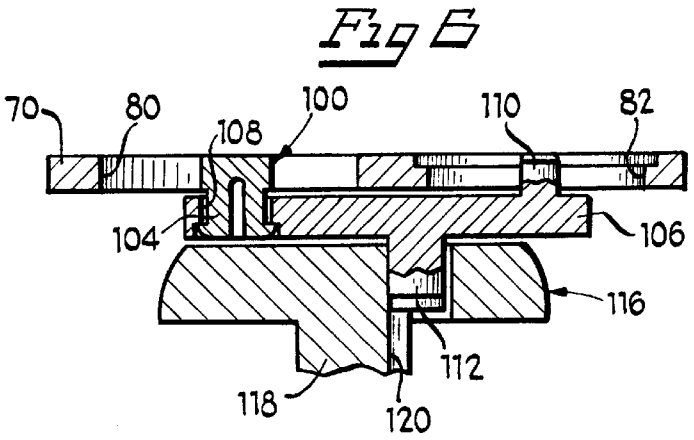
FIG. 6 is a fragmentary sectional view taken generally along line 6—6 of FIG. 5.

Assembled mechanism 45 is sized and designed to fit within the cavity of lower torso 16 formed by shells 16*a* and 16*b*, as is perhaps best illustrated in FIG. 6. Accordingly, the lower portions of each of side mounting plates 70 and 71 are snugly received in the lower portion of the hollow cavity of lower torso 16. The upwardly extending portion of each of central plate 46, right side plate 70 and left side plate 71 are tightly received in the cavity defined by flange 42*a*, 42*b*. Mechanism 45 is further retained within lower torso 16 by the mounting of legs 20 and 21 on each of leg mounting members 116 and 117, respectively. Upper torso 14 is secured to the topmost portion of mechanism 45, and thus mounted in an abutting relationship atop lower torso 14, by the engagement of each of inwardly directed flanges 36*a*, 36*b* and 38*a*, 38*b* with notches 56, 88 and 54, 86 in the center mounting plate 46 and side mounting plates 70, 71.

In the embodiment illustrated and described, there is no motor powering the walking mechanism. Instead, in this embodiment it is intended that the toy will be propelled for movement by the child or other person playing with the toy. When the toy doll 10 has one foot in engagement with a generally planar playing surface as is illustrated in FIG. 1, and a slight pulling or pushing force is exerted such as by grasping an extended arm or hand of the toy doll, a walking motion will be effected. Thus, for example, as the toy doll is pulled forward from the position illustrated in FIG. 1, right foot end 24 stays in contact with surface 28 while hip end 22 pivots forwardly with the torso and head of doll 10. At the same time mechanism 45, which is driven by the angular movement of right leg 20, drives left leg 21 such that it moves upwardly and rearwardly relatively slowly and then much more quickly is propelled downwardly and forwardly to complete the step. This varying speed of movement of the leg results from right leg 20 driving elliptical gear 92, which in turn drives elliptical gear 93 through elliptical gears 90 and 91 serving as idler gears. Because of the varying speed elliptical orbital movement of the legs, the resulting simulated walking motion of the legs is more lifelike than has been obtained through prior, including more complicated, mechanisms.

While a particular embodiment of the present invention has been shown and described, it will be apparent that further changes and alternatives will occur to those skilled in the art. Thus for example, a four-legged walking mechanism may be made embodying the present invention. As a further alternative, a motor may be provided to drive a walking mechanism of the present invention. It is intended in the appended claims to cover all such changes and modifications as fall within the true spirit and scope of the present invention.

What is claimed as new and desired to be secured by letters patent is:

1. A walking mechanism for a toy comprising in combination:

a torso;

a pair of spaced apart mounting plates carried by the torso;

a pair of legs with each leg having a hip end and a foot end;

a common shaft carried between the mounting plates;

a pair of elliptical idler gears mounted on the common shaft for rotation;

the elliptical idler gears being out-of-phase with respect to each other;

a pair of elliptical driving gears, each in driving relationship with a respective one of the elliptical idler gears;

the elliptical driving gears being mounted for out-of-phase rotation with respect to each other;

a pair of stub shafts, each stub shaft mounted for movement with respect to a respective mounting plate; and the hip end of each leg mounted for movement with a stub shaft that is in driven relationship with a respective one of the out-of-phase elliptical driving gears to produce a varying speed, generally elliptical orbital movement of the legs to simulate walking.

2. The walking mechanism of claim 1 in which each of the elliptical idler gears is keyed to the common shaft.

3. The walking mechanism of claim 1 in which the elliptical driving gears are mounted on coaxial mounting shafts.

4. The walking mechanism of claim 1 in which each of the elliptical gears has an odd number of teeth.

5. The walking mechanism of claim 1 in which:

the pair of elliptical idler gears are mounted for 180 degree out-of-phase rotation with respect to each other; and the pair of elliptical driving gears are mounted for 180 degree out-of-phase rotation with respect to each other.

6. A walking mechanism for a toy comprising in combination:

torso;

a pair of spaced apart mounting plates carried by the torso;

a pair of legs with each leg having a hip end and a foot end;

a common shaft carried between the mounting plates;

a pair of elliptical idler gears mounted on the common shaft for rotation;

the elliptical idler gears being out-of-phase with respect to each other;

a pair of elliptical driving gears each in driving relationship with a respective one of the elliptical idler gears;

the elliptical driving gears being mounted for out-of-phase rotation with each other;

pair of stub shafts, each stub shaft mounted for movement with respect to a respective mounting plate;

the hip end of each leg mounted for movement with a stub shaft that is in driven relationship with a respective one of the out-of-phase elliptical driving gears to produce a varying speed, generally elliptical orbital movement of the legs to simulate walking;

an elongated slot in each of the mounting plates; and each of the elliptical driving gears being drivingly connected to the respective stub shaft through at least one member carrying a pin that is received in the respective elongated slot.

7. The walking mechanism of claim 6 in which the elongated slot is arcuate.

8. The walking mechanism of claim 6 in which;

there is a second elongated slot in each of the mounting plates; and the elliptical driving gears are also drivingly connected to the stub shaft through another member that carries a pin received in the respective second elongated slot.

9. The walking mechanism of claim 8 in which each of the elongated slots is arcuate.

10. The walking mechanism of claim 8 in which one of the elongated slots in each of the mounting plates is generally horizontally disposed and the other one of the elongated slots in the same one of the mounting plates is generally vertically disposed.

11. The walking mechanism of claim 10 in which each of the elongated slots is arcuate.

12. The walking mechanism of claim 10 in which the generally horizontally disposed slot is arcuate.

13. The walking mechanism of claim 6 in which each of the elliptical gears has an odd number of teeth.

14. The walking mechanism of claim 6 in which:

the pair of elliptical idler gears are mounted for 180 degree out-of-phase rotation with respect to each other; and the pair of elliptical driving gears are mounted for 180 degree out-of-phase rotation with respect to each other.

15. The walking mechanism of claim 6 in which each of the elliptical idler gears is keyed to the common shaft.

16. The walking mechanism of claim 6 in which the elliptical driving gears are mounted on coaxial mounting shafts.

* * * * *

UNITED STATES PATENT AND TRADEMARK OFFICE

CERTIFICATE OF CORRECTION

PATENT NO. : 5,842,906

DATED : December 1, 1998

INVENTOR(S) : Rouben T. Terzian
R. Blake Kuralt

It is certified that error appears in the above-indentified patent and that said Letters Patent is hereby corrected as shown below:

| | |
|---|---|
| Column 6, Line 49 | insert --a-- before "torso" |
| Column 6, Line 59 | insert a comma --,-- after "gears" |
| Column 6, Line 64 | insert --a-- before "pair" |
| Column 7, Line 11 | delete semi-colon ";" and insert colon --:-- |

Signed and Sealed this

Fourteenth Day of December, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT : 5,842,906

DATED : Dec. 1, 1998

INVENTOR(S) : Terzian et al.

It is certified that error appears in the above-identified patent and that said Letters Patent is hereby corrected as shown below:

| | |
|---|---|
| **Column 4, line 24** | **delete "board" and insert --bore--;** |
| **Column 5, line 27** | **delete "Fig. 6" and insert --Figs. 4 and 5--.** |

Signed and Sealed this

Second Day of May, 2000

*Attest:*

Q. TODD DICKINSON

*Attesting Officer*

*Director of Patents and Trademarks*